US008177112B1

(12) United States Patent
Crawford et al.

(10) Patent No.: US 8,177,112 B1
(45) Date of Patent: May 15, 2012

(54) FIXATION DEVICES FOR COCHLEAR IMPLANT SPEECH PROCESSORS

(75) Inventors: Scott A. Crawford, Castaic, CA (US); Lee F. Hartley, Valencia, CA (US); Tracey L. Kruger, Valencia, CA (US)

(73) Assignee: Advanced Bionics, LLC, Valencia, CA (US)

( * ) Notice: Subject to any disclaimer, the term of this patent is extended or adjusted under 35 U.S.C. 154(b) by 598 days.

(21) Appl. No.: 12/394,549

(22) Filed: Feb. 27, 2009

(51) Int. Cl.
*A45F 5/00* (2006.01)
*A45F 3/00* (2006.01)

(52) U.S. Cl. ..... 224/666; 224/668; 224/676; 224/930

(58) Field of Classification Search ..... 224/666–676, 224/930; 24/46, 351
See application file for complete search history.

(56) References Cited

U.S. PATENT DOCUMENTS

| | | | | |
|---|---|---|---|---|
| 4,083,481 | A * | 4/1978 | Selinko | 224/670 |
| 4,341,212 | A | 7/1982 | Medwid | |
| 4,985,968 | A | 1/1991 | Hooper | |
| 5,370,622 | A * | 12/1994 | Livingston et al. | 604/151 |
| 5,415,642 | A | 5/1995 | Shepherd | |
| 5,458,124 | A | 10/1995 | Stanko et al. | |
| 5,472,317 | A | 12/1995 | Field et al. | |
| 5,831,827 | A | 11/1998 | Fekete et al. | |
| 6,041,259 | A | 3/2000 | Agarwala et al. | |
| 6,454,146 | B2 | 9/2002 | Alis | |
| 6,561,702 | B1 * | 5/2003 | Yik | 396/420 |
| 6,579,268 | B1 | 6/2003 | Loining | |
| 6,758,338 | B2 | 7/2004 | Lien | |
| 7,096,687 | B2 | 8/2006 | Trinh et al. | |
| 2003/0110595 | A1 | 6/2003 | Collins et al. | |
| 2005/0263549 | A1 | 12/2005 | Scheiner | |
| 2008/0292124 | A1 | 11/2008 | Rosenow et al. | |

FOREIGN PATENT DOCUMENTS

| | | |
|---|---|---|
| WO | 03101349 | 12/2003 |

OTHER PUBLICATIONS

Med-El Medical Electronics Tempo+ and Accessories Product Catalogue MKT1016E rev 1.0., retrieved Feb. 27, 2009 from http://www.medel.co.jp/shared/pdf/catalogue/mkt1016e_r1.0_tempo+.pdf.
Freedom Babyworn(tm) Accesory Pack, retrieved from http://www.cochlearstore.com/index.php? main_page=product_info&products_id=30 (1 of 2) [Feb. 26, 2009 12:28:46 PM].
http://www.racer.com.sg, Racer Technology Medical Brochure cover page and p. 1, retrieved May 9, 2008.

* cited by examiner

*Primary Examiner* — Justin Larson
*Assistant Examiner* — Adam Waggenspack
(74) *Attorney, Agent, or Firm* — Mary Elizabeth Bush

(57) ABSTRACT

A kit of fixation devices for cochlear implant speech processors comprising a spring loaded alligator clip including front and rear pivotally connected legs, a top portion of the front leg forming a support latch with an upper portion of one of several vertically extending cradles shaped to receive and support speech processors of different size while (i) allowing for replacement of the battery pack of the processor, (ii) protecting the control panel thereof against accidental actuation and (iii) supporting the processor cable, the front and rear legs of the alligator clip including hooks for engaging and capturing a safety pin that may have been already attached to the clothing of a user of the processor.

14 Claims, 10 Drawing Sheets

FIXATION DEVICES FOR COCHLEAR IMPLANT SPEECH PROCESSORS

FIELD OF INVENTION

The present invention relates to fixation devices for supporting and releasably attaching a speech processor of a cochlear implant system to a user of the system.

BACKGROUND OF INVENTION

Cochlear implant systems commonly comprise external and implanted components. The external components usually include a battery powered processor for receiving sounds that are converted into coded electrical signals transmitted to the implanted components of the system. The coded electrical signals are further processed within the implanted components and transmitted to an implanted cochlear electrode where they stimulate the cochlear nerve to produce sensations representative of the sounds received by the external processor.

The external portion of a cochlear implant system is commonly secured by a fixation device to the belt or other clothing of the system user. Such fixation devices range from pins such as safety or diaper pins that pierce the clothing of the system user, to clips that releasably support and secure the external processor to a belt of the system user. Examples of fixation devices that may be used for such purposes are described and illustrated in United States Patent Application Publications 2005/0263549 and 2003/0110595, and in U.S. Pat. No. 5,472,317, which are incorporated herein by this reference, to list just few. Also, the FREEDOM Babyworn Accessory Pack from Cochlear Limited includes a plastic retention case for an external speech processor of a cochlear implant system that is attachable by hooks to either a safety pin or an alligator clip fixation device that, in turn, is attachable to the clothing or belt of a system user.

It is important to note that the foregoing fixation devices are designed to support a single size speech processor and do not include protection for the associated control panel of the processor against accidental actuation or the cable of the processor and do not allow for replacement of the battery pack of the processor while attached to the fixation device. Also, the fixation devices that incorporate safety pins are difficult or impossible to attach to a safety pin if the safety pin has first been attached to the clothing of the system user.

Accordingly, there is a need for improved fixation devices that are capable of supporting the speech processors of cochlear implant systems while protecting the control panels and cables of different size speech processors having replaceable battery packs and which may be easily secured to a safety pin already attached to the clothing of the system user. The present invention satisfies each of the foregoing needs.

SUMMARY OF INVENTION

Basically, the fixation devices of the present invention satisfy the foregoing needs by comprising a spring loaded belt clip including front and rear pivotally connected legs, a top portion of the front leg forming a support latch with an upper portion of one of several vertically extending cradles shaped to receive and releasably support speech processors of different sizes while (i) allowing for replacement of the battery pack of the processor, (ii) protecting the control panel thereof against accidental actuation, and/or (iii) supporting the processor cable of the processor. Further, the front and rear legs of the belt clip include means for engaging and releasably capturing a safety pin that may have already been attached to the clothing of a user of the processor. The foregoing as well as other structures and features of the present invention may be more fully understood by reference to the following detailed description referring to the drawings briefly described as follows.

DETAILED DESCRIPTION OF INVENTION

Figure 1:
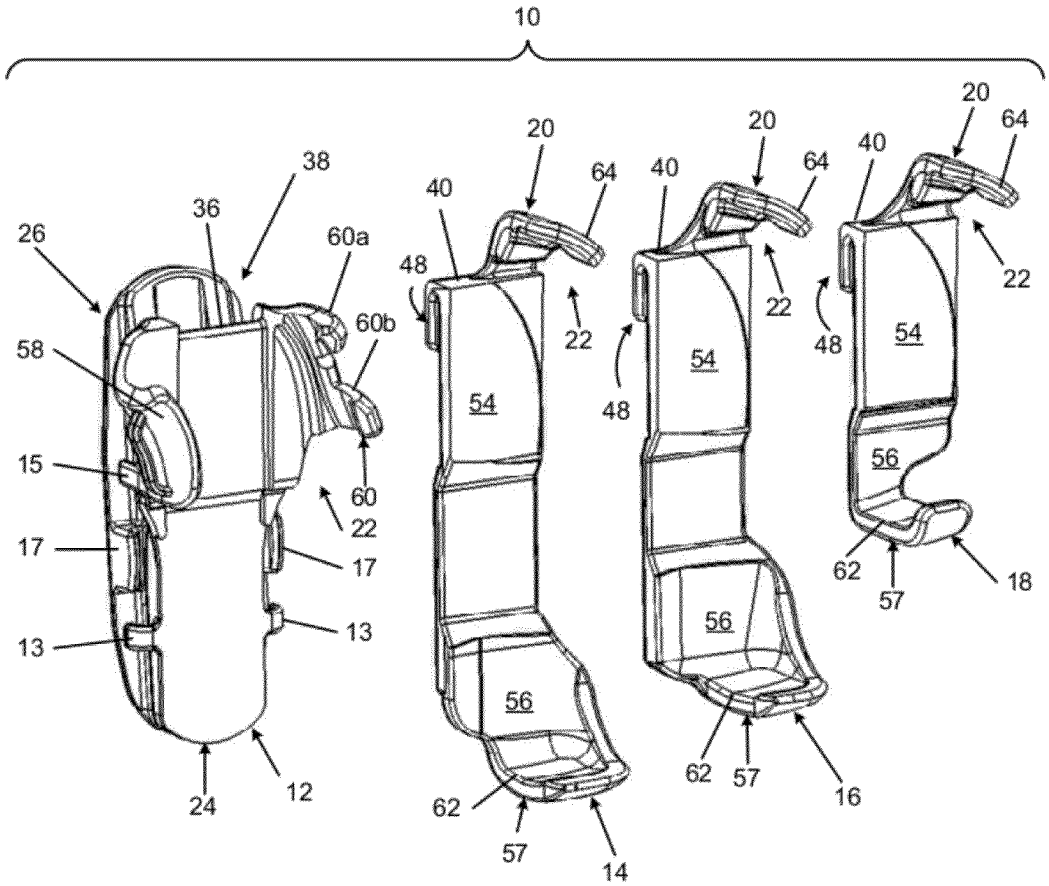
FIG. 1 shows a speech processor fixation kit according to the present invention comprising a spring loaded clip designed for connection to a safety pin or to a belt worn by a cochlear implant system user and releasably connectable to any one of several different size speech processor support cradles each including protective structure for the control panel of the processor and combining with structure of the clip to provide protective routing for the processor cable, the support cradles being shaped to allow replacement of a battery pack of the different size speech processors supported by the cradles.
Figure 2:
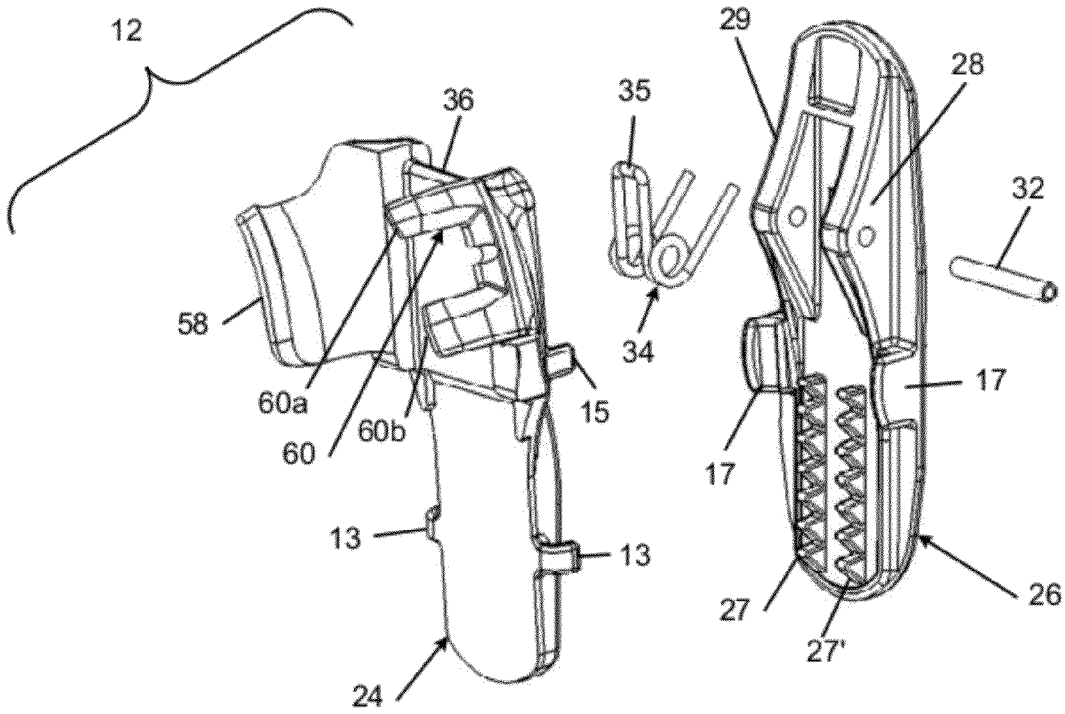
FIG. 2 is an enlarged exploded perspective view of the belt clip shown in FIG. 1.

Basically, the present invention comprises a fixation device kit and the components thereof for supporting different size speech processors of cochlear implant systems while protecting the control panels and cables of the processors and while providing easy removal and replacement of the battery packs of the supported processors and releasable attachment to a safety pin already attached to the clothing of the system user. FIG. 1 shows a speech processor fixation kit 10 according to the present invention comprising a spring loaded belt clip 12 designed for connection to a safety pin or to a belt worn by a cochlear implant system user and releasably connectable to any one of several different size speech processor support cradles 14, 16, or 18 each including protective structure 20 for the control panel of the processor and combining with structure 22 of the clip 12 to provide protective routing for the processor cable, the support cradles being shaped to allow replacement of a battery pack of the different size speech processors supported by the cradles. As depicted in FIG. 2, the spring loaded belt clip 12 of the kit 10 comprises pivotally interconnected front and rear legs 24 and 26 with inter-fitting pivot brackets that may be molded from a lightweight plastic material. In that regard, laterally spaced outer pivot brackets 28 and 29 extend forwardly from a front face of the rear leg 26 while an inner pivot bracket 30 (FIGS. 2*c* and 3*b*) extends from a rear face of the front leg 24 between the brackets 28 and 29 with aligned holes for receiving a horizontally extending pivot pin 32. Further, a torsion spring 34 is wrapped around the pivot pin 32 with a central loop 35 extending over a top of the pivot bracket 30 and with opposite ends the spring secured to the front face of the rear leg 26 opposite the central loop 35 to urge lower ends of the legs 24 and 26 toward a normally closed position. Thus configured, simultaneous inward forces exerted on upper portions of the legs 24 and 26 above the pivot pin 32 will produce a pivoting of the legs on the pivot pin to separate lower portions of the legs allowing the belt clip to assume an open position for fitting over a belt or other articles of clothing worn by a user.

Figure 2A:
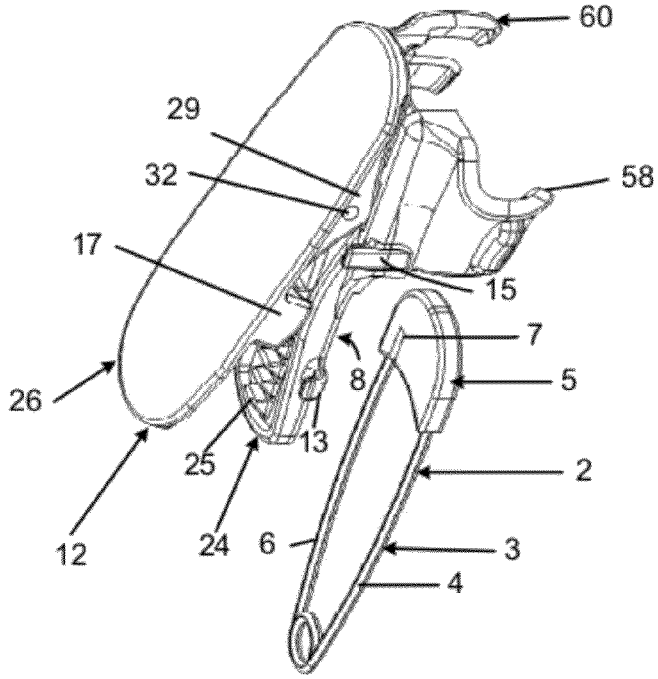
FIGS. 2*a-c* illustrate the structure and method of releasable connection of the belt clip shown in FIG. 1 to a safety pin.
Figure 2B:
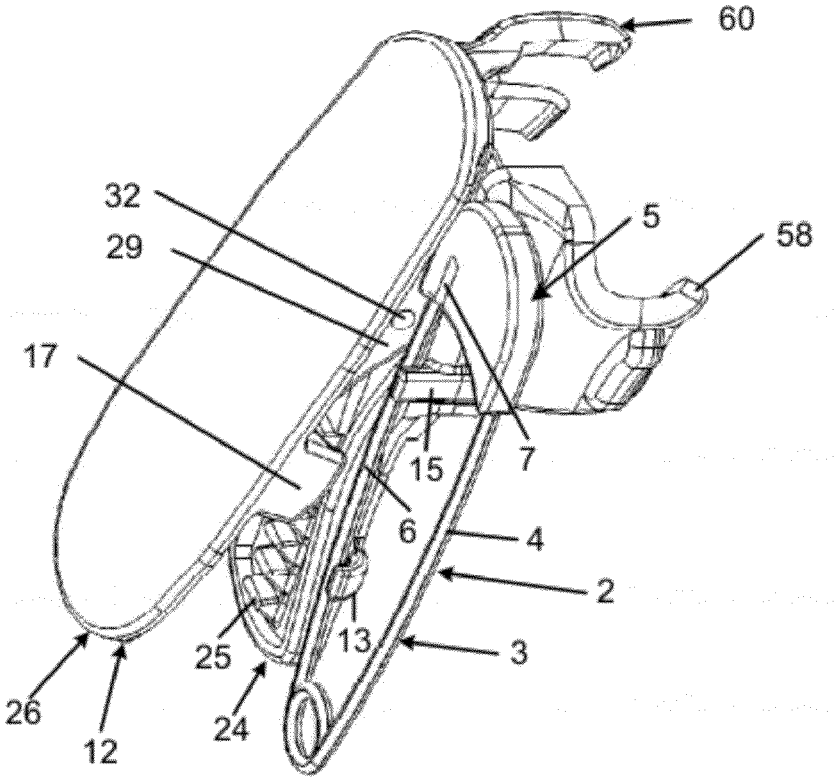

As further depicted in FIG. 2, the belt clip may be an alligator clip where the front and rear surfaces of the legs 26 and 24, respectively, below the pivot pin 32 include two laterally spaced vertical rows 27,27' and, as shown in FIGS. 2*a* and 2*b*, a central vertical row 25 of teeth for aiding in the gripping of a belt or other article of clothing by the clip in its normally closed position.

Figure 2C:
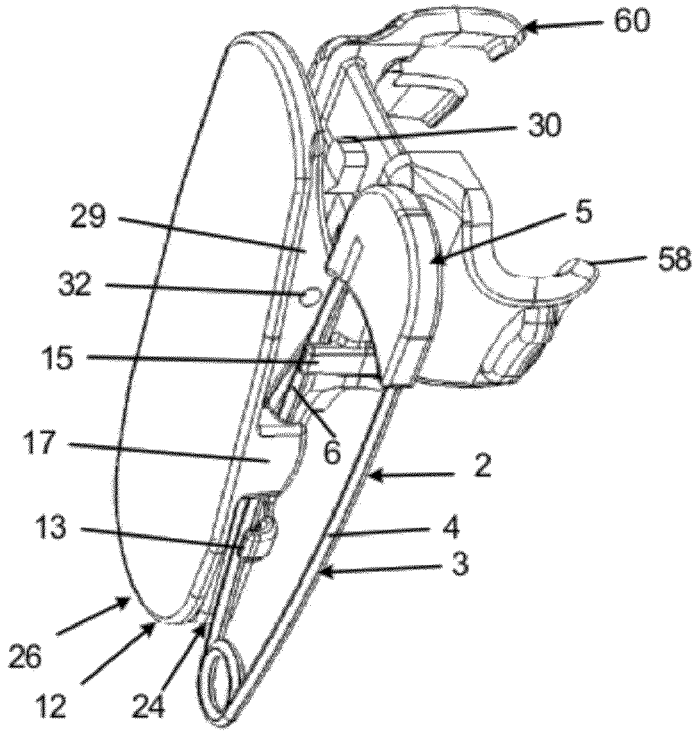

As previously indicated with respect to the fixation device kit 10 of FIG. 1, the belt clip 12 included in the kit is designed to be releasably connectable to a safety pin that is or subsequently may be connected to clothing of a user of the fixation device. In that regard, FIGS. 2*a-c* illustrate the structure of the clip 12 and the process whereby the clip may be releasably connected to a conventional safety pin 2. By way of example only, the illustrated safety pin 2 comprises a looped U-shaped metal pin 3 having a vertically extending leg 4 fixedly secured at its upper end to a bottom of a clasp 5 and a vertically extending leg 6 releasably secured at its upper end within a slot 7 in a bottom of the clasp spaced from the leg 4. In FIG. 2*a*, the releasable leg 6 is depicted as being adjacent the clip 12, it being assumed by such an arrangement that the secured leg 4 of the safety pin already extends into and through clothing of the user of the fixation device including the clip 12. In this regard, please note that if it is intended to attach the safety pin to an article of clothing after the pin is releasably attached to the clip, the fixed leg 4, rather than the releasable leg 6, should be positioned adjacent the clip 12 the leg 6 being free to pierce and extend through clothing of the user. In either event, the clip 12 includes means 8 for engaging and receiving a safety pin when the clip is in an open condition (FIGS. 2*a* and *b*) and for capturing the safety pin when the clip is in its normally closed condition (FIG. 2*c*) to secure the clip to clothing to which the safety pin already may be attached. As depicted in FIGS. 2*a-c*, the illustrated version of the means 8 for engaging and capturing a safety pin includes vertically spaced inwardly extending hook members 13 and 15 along outer vertical edges the front leg 24 of the clip and inwardly extending central hook members 17 along outer edges of the back leg 26 between the hook members 13 and 15 of the clip. As shown in FIGS. 2*a* and *b*, to secure the safety pin 2 to the clip 12, the safety pin is placed adjacent the clip when in an open condition as shown in FIG. 2*a* and the leg 6 of the clip moved over the hooks 13 and 15 as shown in FIG. 2*b*. The clip 12 is then released to return to its normally closed position, capturing the leg 6 of the safety pin 4 between the hooks as depicted in FIG. 2*c*.

Figure 3A:
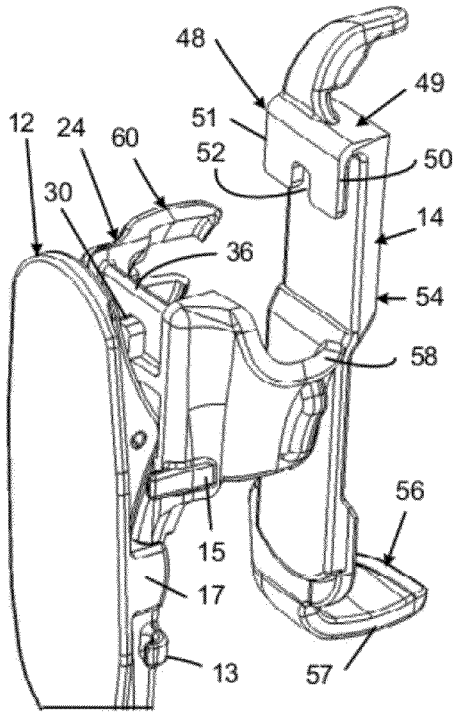
FIGS. 3*a-c* illustrate the structure and method of releasable connection of the belt clip to the largest of the speech processor support cradles shown in FIG. 1.
Figure 3B:
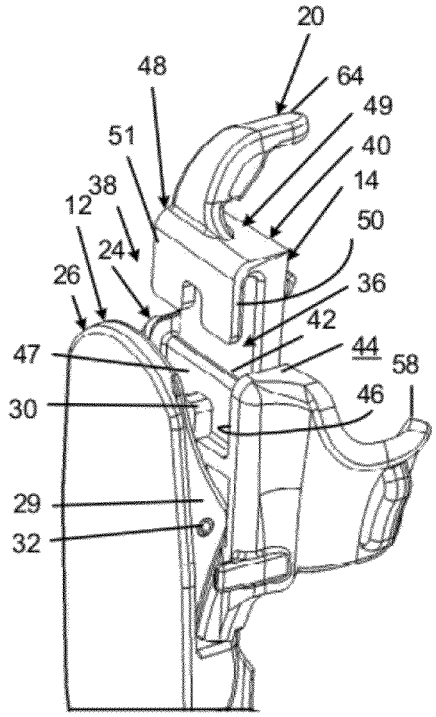
Figure 3C:
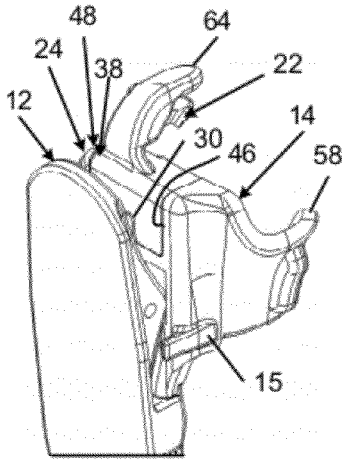
Figure 4A:
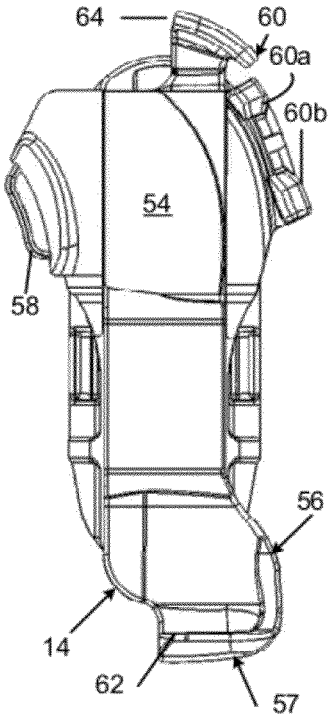
FIGS. 4*a-c* are respectively front, side and isometric views of the assembled belt clip and speech processor cradle of FIG. 3*c*.
Figure 5A:
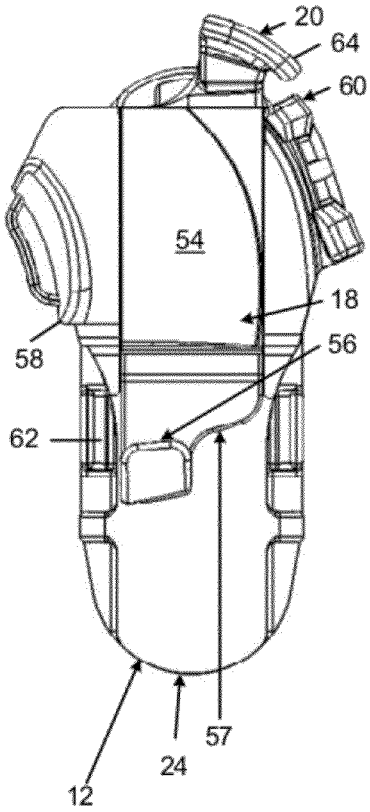
FIGS. 5*a-c* are respectively front, side and isometric views of the assembled belt clip and smallest of the three speech processor cradles shown in FIG. 1.
Figure 5B:
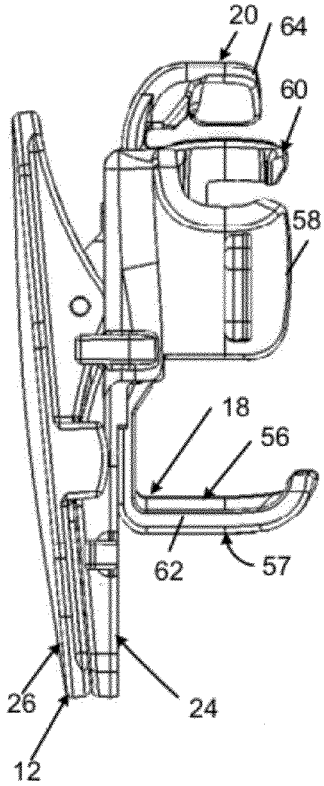
Figure 5C:
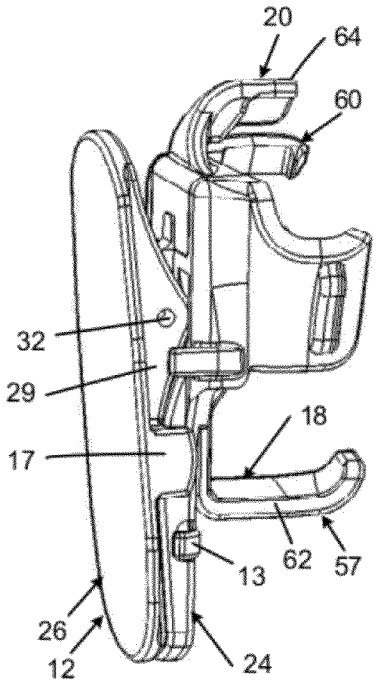

As also previously indicated with respect to the fixation device kit 10 of FIG. 1, the belt clip 12 is designed to be releasably connectable to any one of the several different size speech processor support cradles 14, 16, or 18 preferably molded of a lightweight plastic material. As depicted in FIGS. 3*a-c*, such a releasable connection is provided by a top portion 36 of the front leg 24 forming a support latch 38 with an upper portion 40 of each of the several vertically extending cradles 14, 16 and 18 shaped to receive and support speech processors of different size. A preferred form of the support latch 38 is depicted most clearly in FIGS. 3*a-c* as comprising a laterally extending horizontal tongue 42 in the top surface 44 of the front leg 24 open to a vertically extending channel 46 on a back 47 of the front leg and a laterally extending inverted U-shaped hook 48 extending rearward from a top 49 of the upper portion 40 of each of cradles 14, 16 and 18 and downward into the tongue 42 with vertical sides 50 and 51 of the hook 48 engaging opposite sides of the vertical channel 46 and a vertical slot 52 in the hook 48 engaging opposite sides and top of the pivot bracket 30 extending from the back of the front leg 24. FIGS. 3*a-c* depict the steps of releasable connection of the clip 12 to the speech processor cradle 14: FIG. 3*a* showing the cradle 14 spaced to the right of the clip 12, FIG. 3*b* showing the cradle 14 against the clip 12 with the hook 48 above the tongue 42 and channel 46, and FIG. 3*c* showing the cradle 14 lowered until he hook 48 is engaged with the tongue 42, channel 46 and pivot bracket 30 to secure the cradle 14 to the clip 12. FIGS. 4*a, b* and *c* are front, side and isometric views showing the cradle 14 so secured to the clip 12 ready for support of a speech processor while FIGS. 5*a, b*, and *c* are similar views of the cradle 18 secured to the clip 12 by the same process steps as depicted in FIGS. 3*a-c*.

From each of FIGS. 3*a*-5*c* it should be appreciated that such support of the different size speech processors is provided by back and base portions 54 and 56 of each of the cradles 14, 16 and 18 as well as arms 58 and 60 extending forward from upper portions of opposite vertical sides of the front leg 24 of the clip 12, such arms being shaped to receive, support and embrace the different size speech processors supported by the cradles 14, 16 and 18.

Back portion 54, as most clearly shown in FIG. 4*b*, extends vertically downward from a top of the hook 48 to a point slightly below the arm 58 where it steps rearward to provide a space 61 between a back of a supported speech processor and a forward face of the back portion 54 of the cradle which continues vertically downward to the base portion 56 of the cradle.

Figure 4C:
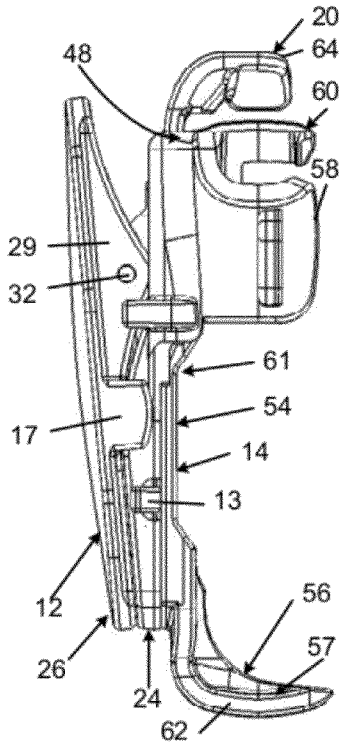
Figure 4B:
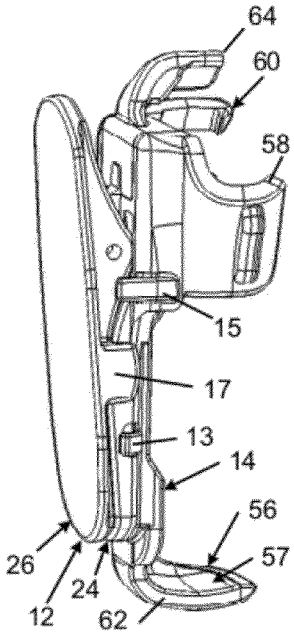

With regard to the base portion 56, as clearly shown in each of FIGS. 4*a-c*, the base portion 56 extends forward and downward from the back portion 54 beginning at a point slightly above a bottom of the front leg 24 of the clip. From that location, a right side of the base portion 56 curves forward and downward to a slightly concave forwardly extending horizontal bottom 57 having an open left side 62 and shaped to receive a bottom of a speech processor.

With regard to the arms 58 and 60, the arm 58 extends slightly outward and forward from an upper left side of the back portion 54 adjacent a left side of the tongue 42 curving inward to the right at its forward end. The arm 60, on the other hand, extends slightly outward from a right side of the back portion 54 adjacent a right side of the tongue 42 dividing into arm components 60*a* and 60*b* as they curve inward to the left at the forward ends of the arm components.

Figure 6A:
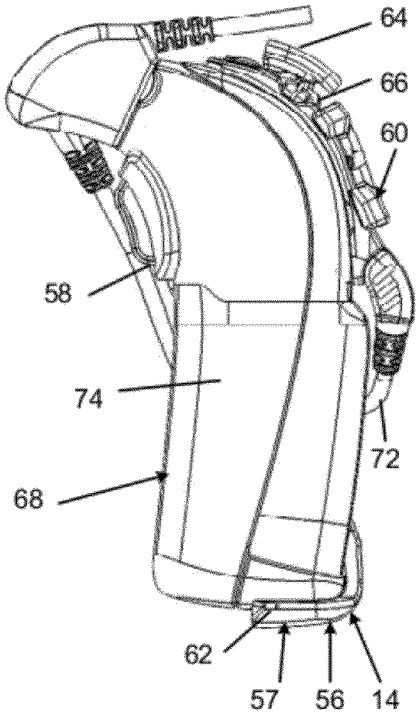
FIGS. 6*a-c* are respectively front, side and isometric views of the assembled belt clip and speech processor cradle of FIG. 3*c* supporting a large speech processor and illustrating the manner that the belt clip and cradle protect the processor control panel and cable.
Figure 6B:
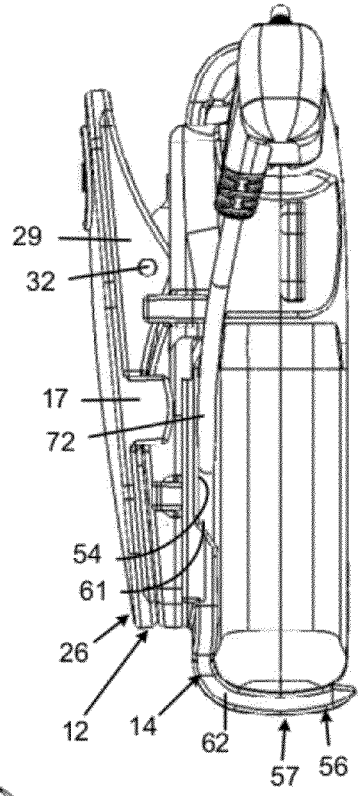
Figure 6C:
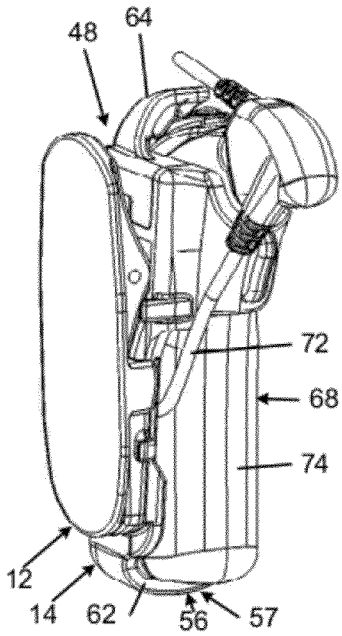
Figure 7A:
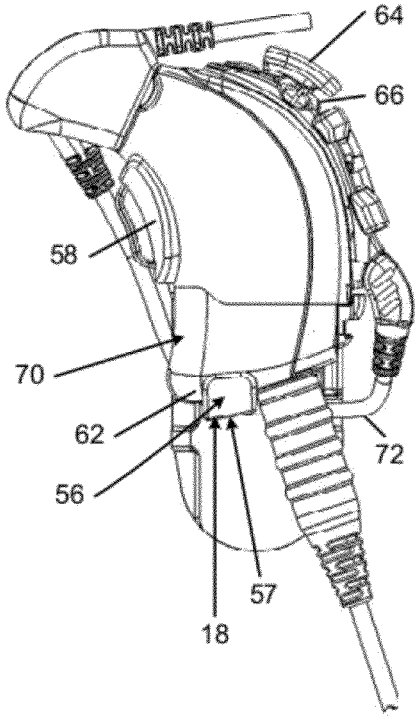
FIGS. 7*a-c* are respectively front, side and isometric views of the assembled belt clip and smallest of the three speech processor cradles shown in FIG. 1 supporting a small speech processor and illustrating the manner that the belt clip and cradle protect the processor control panel and cable.
Figure 7B:
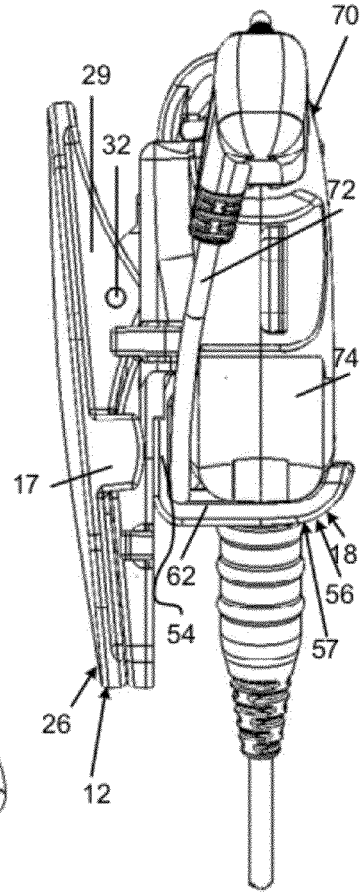

Also from FIGS. 3*a*-5*c*, it should be appreciated that the previously referenced protection structure 20 for the control panel of speech processors supported by the cradles 14, 16 and 18 is provided by an arm 64 extending upward and forward from a top of each of the cradles. The protective relationship of the arm 64 for the control panels 66 (FIG. 6*a*) of speech processors supported by the cradles as well as the speech processor support provided by the cradle back and base portions 54 and 56 and clip arms 58 and 60 is further confirmed in FIGS. 6*a*-7*c*. Specifically, such a protective relationship between the arm 64 and the control panel of a cradle-supported speech processor is clearly indicated in FIGS. 6*a* and 7*a*. The speech processor support provided by the back and base portions 54 and 56 of the cradle and the arms 58 and 60 is clearly indicated in FIGS. 6*a, b* and *c* and FIGS. 7*a, b* and *c*, FIGS. 6*a-c* and FIGS. 7*a-c* respectively being front, side and isometric views of speech processors 68 and 70 supported by the cradles 14 and 18 releasably secured to the belt clip 12.

Figure 7C:
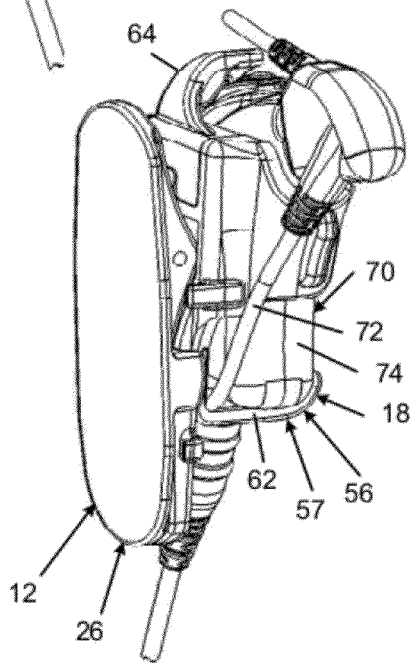
Figure 8A:
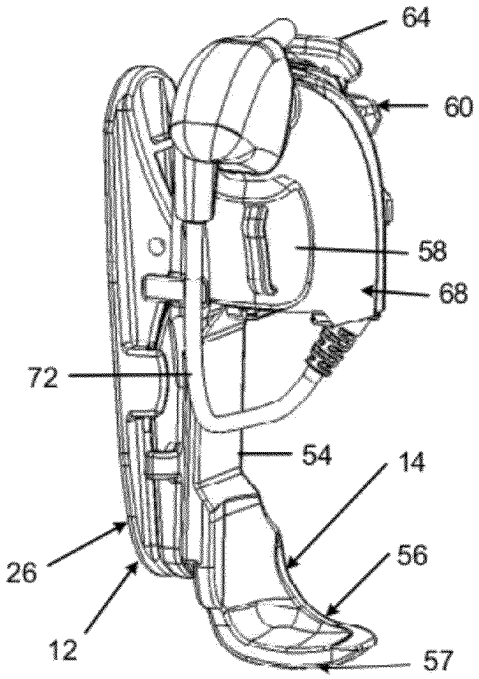
FIGS. 8*a-d* further illustrate the routing for the cable of the speech processor as supported by the fixation device shown in FIGS. 6*a-c*, with FIG. 8*a* showing the processor after its battery pack has been removed.
Figure 8B:
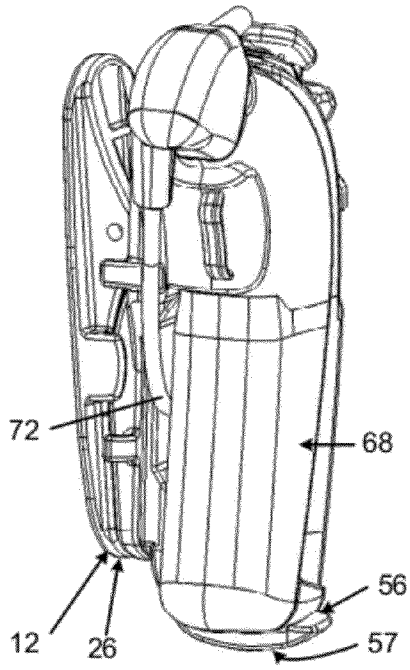
Figure 8C:
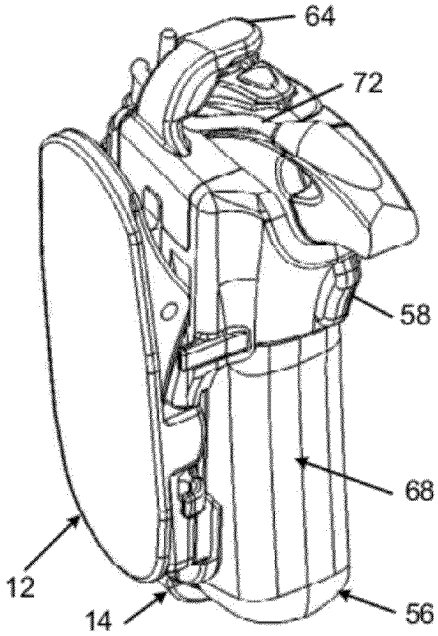
Figure 8D:
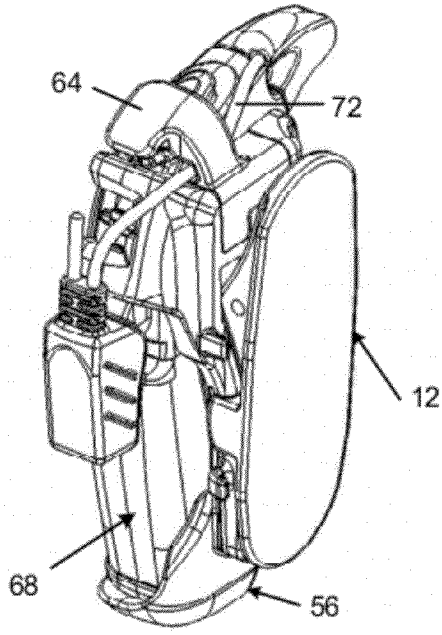

Also, from FIGS. 3*a*-5*c* as well as FIGS. 6*a*-7*c* and FIGS. 8*a-d*, it should be appreciated that the previously referenced protection and cable routing structure 22 of the fixation devices of the present invention comprising the space 61 formed between the back portion 54 and the speech processor, the underside of the base portion 56 of the cradles 14 and 18, and the underside of the control panel protecting arm 64 provide protected and controlled routing for the processor cable 72. It should also be appreciated that the fixation devices of the present invention can accommodate various cable configurations. Note, for example, the various cable configurations of FIGS. 6*a*-8*d*. As can be seen in the configuration shown in FIG. 6*b*, cable 72 is routed through space 61 formed between the back portion 54 of the cradle 14 and the speech processor 68. In other configurations, such as shown in FIG. 7*b-c*, the cable 72 is routed along the junction of back portion 54 and base portion 56. Note also, that while the cable 72, as shown in FIGS. 8*c* and *d*, may be routed under and protected by control panel protecting arm 64, it need not be, as shown in FIGS. 6*a*-7*c*. Thus, the present invention is adaptable to many different speech processor and cable configurations.

Figure 9A:
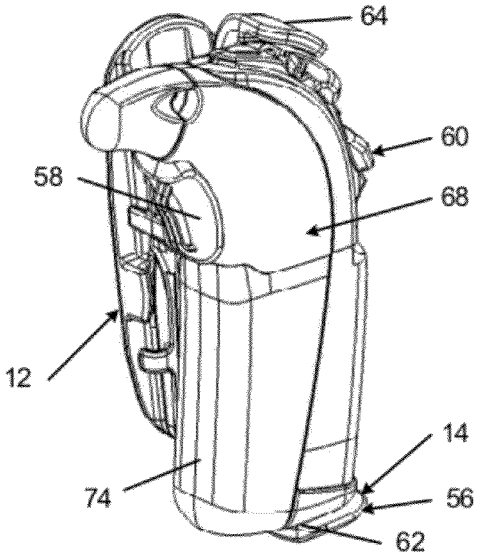
FIGS. 9*a-d* are isometric views of the speech processor of FIGS. 6*a-c* supported by the assembled belt clip and cradle of FIG. 3*c*, illustrating the structure and process of removal of a battery pack from the supported speech processor.
Figure 9B:
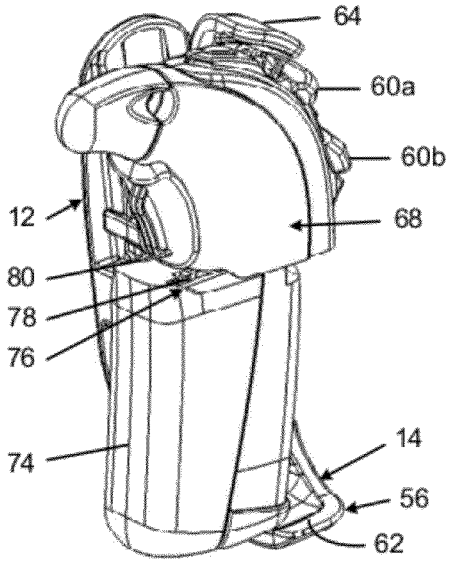
Figure 9C:
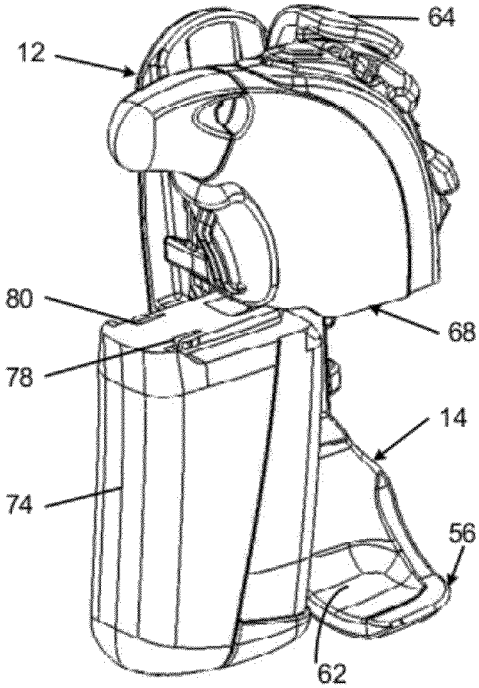
Figure 9D:
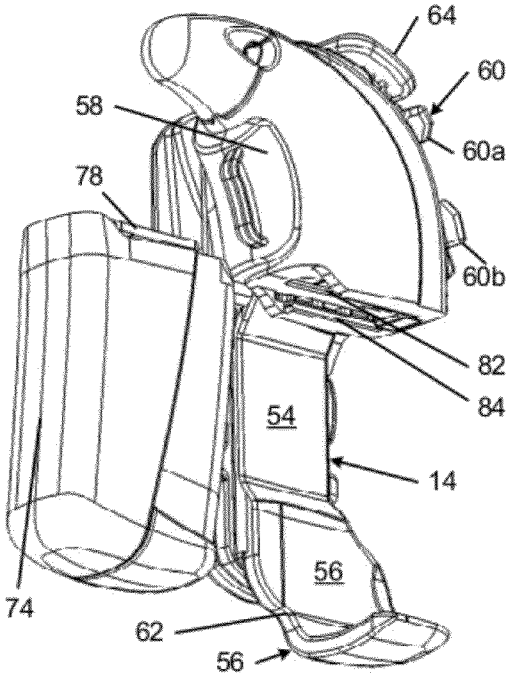

Finally, by reference to FIGS. 9*a-d*, it should be appreciated that the open side 62 of each of the speech processor support cradles 14, 16 and 18 provides a path for the removal of a battery pack portion 74 of the speech processor 68 supported by the cradle 14. Specifically, as shown in FIG. 9*a*, the open side 62 of the cradle 14 allows the supported speech processor 68 including its battery pack 74 to extend laterally through and beyond the open side 62 while the balance of he speech processor is securely supported by the back and base portions 54 and 56 of the cradle and the arms 58 and 60 of the belt clip 12. Then, as shown in FIG. 9*b*, when it is desired to separate the battery pack 74 from the balance of the speech processor 68, the lower battery pack 74 is moved to the left relative to an upper portion of the speech processor 68 by virtue of a slide connection 76 between a top of the battery pack and the upper portion of the speech processor. As illustrated in FIGS. 9*b-d*, the slide connection 76 preferably comprises rearward spaced laterally extending dovetail rails 78 and 80 on a top of the battery pack 74 riding in rearwardly spaced laterally extending dovetail slots 82 and 84 in a base of the upper portion of the speech processor 68. The initial movement of the battery pack 74 relative to the speech processor 68 is depicted in FIG. 9*b* followed by further movement of the battery pack 74 as illustrated in FIG. 9*c* and separation of the battery pack from the speech processor as illustrated in FIG. 9*d*. Replacement of the battery pack 74 and reconnection to the speech processor 68 will follow a reverse the steps shown in FIGS. 9*d* to 9*a*.

While in the foregoing, preferred embodiments of the present invention and the modes of assembly thereof have been described and illustrated, changes and modifications may be made without departing from the spirit of the present invention. Accordingly the present invention is to be limited in scope only by the following claims.

The invention claimed is:

1. A fixation device for a cochlear implant speech processor comprising:

a spring loaded clip including vertically extending front and rear pivotally connected legs, the front leg having an upper portion and arms extending forward from opposite vertically extending sides thereof to embrace a speech processor, a vertically extending cradle including a back having an upper portion for support between the forwardly extending arms of the clip and a base shaped to releasably receive and support a speech processor, and a top of the front leg of the clip and the upper portion of the cradle forming a support latch for releasably securing the cradle to the front leg of the clip wherein when the cradle is attached to the clip, the arms engage the speech processor.

2. The fixation device of claim 1 wherein the support latch comprises:

a vertically extending channel on a back of the front leg, a laterally extending horizontal tongue in a top surface of the front leg of the clip open to the vertically extending channel on the back of the front leg and a laterally extending inverted U-shaped hook extending rearward from a top of the cradle onto the horizontal tongue of the front leg of the clip with vertical edges of the hook engaging sides of the vertically extending channel.

3. The fixation device of claim 1 wherein the front and rear legs of the clip include hook members for engaging and receiving a safety pin when the clip is in an open condition and for capturing the safety pin when the clip is in a closed condition to secure the clip to clothing to which the safety pin may already be attached.

4. The fixation device of claim 3 wherein the hook members for engaging and capturing a safety pin include vertically spaced hook members on one of the front and back legs of the clip and facing the other of the front and back legs for receiving a vertical leg of a safety pin when the clip is in an open condition and a central hook member on the other of the front and back legs of the clip between the hooks on the one of the front and back legs for engaging the vertical leg of the safety pin when the clip is in a closed position.

5. The fixation device of claim 1 wherein the base of the support cradle includes an open side for passing a battery pack of the speech processor as it is separated from the supported speech processor for replacement or recharging.

6. The fixation device of claim 1 wherein an upper portion of the support cradle includes a forwardly extending cover for protecting a control panel of the speech processor from accidental actuation.

7. The fixation device of claim 1 wherein the support cradle includes support surfaces for routing and protecting a cable of the processor supported by the cradle.

8. A kit of fixation devices for supporting different size speech processors of cochlear implant systems, comprising:

a spring loaded clip including vertically extending front and rear pivotally connected legs, the front leg having an upper portion and arms extending forward from opposite vertically extending sides thereof to embrace speech processors of different sizes, a plurality of differently sized vertically extending cradles each including an back having an upper portion for support between the forwardly extending arms of the clip and each having a base shaped to releasably receive and support a speech processor of a different size, and a top of the front leg of the clip and the upper portion of each of the cradles forming a releasable support latch for each of the cradles to the front leg of the clip wherein when the cradle is attached to the clip, the arms engage the speech processor.

9. The kit of claim 8 wherein each support latch comprises:

a vertically extending channel on a back of the front leg of the clip, a laterally extending horizontal tongue in a top surface of the front leg of the clip open to the vertically extending channel on the back of the front leg and a laterally extending inverted U-shaped hook extending rearward from a top of each of the cradles onto the horizontal tongue of the front leg of the clip with vertical edges of the hook engaging sides of the vertically extending channel.

10. The kit of claim 8 wherein the front and rear legs of the belt clip include hook members for engaging and receiving a safety pin when the clip is in an open condition and for capturing the safety pin when the clip is in a closed condition to secure the clip to clothing to which the safety pin may already be attached.

11. The kit of claim 10 wherein the hook members for engaging and capturing a safety pin include vertically spaced hook members on one of the front and back legs of the clip and facing the other of the front and back legs for receiving a vertical leg of a safety pin when the clip is in an open condition and a central hook member on the other of the front and back legs of the clip between the hooks on the one of the front and back legs for engaging the vertical leg of the safety pin when the clip is in a closed position.

12. The kit of claim 8 wherein the base of the support cradles include open sides for passing speech processor battery packs as they separate from the supported speech processors for replacement or recharging.

13. The kit of claim 8 wherein backs of the support cradles include forwardly extending cover arms for protecting control panels of the speech processors supported by the cradles from accidental actuation.

14. The kit of claim 8 wherein each of the processor support cradles includes support surfaces for routing and protecting cables of the processor supported by the cradle.

* * * * *